United States Patent [19]

Tokoro et al.

[11] Patent Number: 4,806,979

[45] Date of Patent: Feb. 21, 1989

[54] DUPLEX PRINTING MACHINE

[75] Inventors: Hiroyoshi Tokoro; Tsuneki Kobayashi; Kensei Hosoya; Shogo Nobumori; Mitsuaki Hayakawa, all of Ibaraki, Japan

[73] Assignee: Hitachi Koki Co., Ltd., Tokyo, Japan

[21] Appl. No.: 56,016

[22] Filed: Jun. 1, 1987

[30] Foreign Application Priority Data

May 30, 1986 [JP] Japan ..... 61-124991

[51] Int. Cl.[4] ..... G03G 15/00

[52] U.S. Cl. ..... 355/14 SH; 355/77; 355/24; 355/3 SH

[58] Field of Search ..... 355/23, 24, 25, 26, 355/3 SH, 14 SH, 77; 271/902, 291, 301, 302

[56] References Cited

U.S. PATENT DOCUMENTS

| | | | |
|---|---|---|---|
| 4,214,831 | 7/1980 | Reesen | 355/24 |
| 4,365,886 | 12/1982 | Murakami et al. | 355/23 X |
| 4,453,819 | 6/1984 | Wada et al. | 355/23 X |
| 4,468,114 | 8/1984 | Pels et al. | 355/24 X |
| 4,487,506 | 12/1984 | Repp et al. | 355/24 X |
| 4,650,313 | 3/1987 | Koike | 355/23 X |

*Primary Examiner*—R. L. Moses

*Attorney, Agent, or Firm*—Sughrue, Mion, Zinn, Macpeak & Seas

[57] ABSTRACT

In a perfecting printing machine, a switch-back mechanism moves backwardly each sheet delivered out of the printing section, and a switching gate provided immediately after the switch-back mechanism selects a first sheet path to return the sheet whose one side has been printed to the printing section and a second sheet path so that the sheet whose both sides have been printed is delivered to the stacker after being moved backwardly by the switch-back mechanism.

3 Claims, 4 Drawing Sheets

DUPLEX PRINTING MACHINE

BACKGROUND OF THE INVENTION

1. Field of the Invention

This invention relates to electrophotographic printing machines using cut sheets, and more particularly to a printing machine for printing both sides of a cut sheet, namely, a duplex printing machine.

2. Description of the Prior Art

One example of a conventional duplex printing machine, a laser printer, will be described with reference to FIG. 1.

In the printing machine of FIG. 1, a photosensitive drum 1 is charged by a charging unit 2, and a latent image is formed on the photo-sensitive drum 1 with a laser beam 3. The latent image is developed with toner 12 by a developing unit 4.

On the other hand, a sheet 6 supplied by a sheet supplying roller 9 is conveyed to an image transferring section of the photo-sensitive drum 5 by a sheet conveying roller 13, where the toner image on the drum is transferred onto the sheet 6 by an image transferring corotron 5. Thereafter, the sheet 6 is discharged by a peeling corotron 11 so that it is peeled off the drum 1. The sheet 6 thus peeled off is conveyed to a fixing unit 8 by an endless conveyor belt 7 so that the image is fixed on the sheet. The toner remaining on the drum 1 is removed by a cleaning unit 10. Thus, one side of the sheet has been printed.

For double sided printing, the sheet is delivered onto a reversing plate 15 by a pair of sheet delivery rollers 14 and is then moved backwardly into the printing machine by a conventional switch-back mechanism, namely, a reversing roller 16 which is rotated by one of the sheet delivery rollers 14. That is, the sheet 6 is moved along a sheet return path 17 and is again fed to the photosensitive drum 1 by the conveying rollers 13, where the other side of the sheet is treated in the same manner as in the first path. The sheet is conveyed to the fixing unit 8 by the endless conveyor belt 7, where the image is fixed. Thereafter, the sheet 6 is delivered out of the printing machine by the sheet delivery rollers 14. In this operation, a sheet path switching gate 18 provided at the sheet inlet side of the reverse plate 15 is swung from the position A to the position B as shown in FIG. 1 to deliver the sheet, both sides of which have been printed, to a stacker 19.

In the above-described method, as is apparent from FIG. 2, it is impossible to swing the gate 18 as long as a sheet 20, only one side of which has been printed, is present on the reversing plate 15. Therefore, in the case where a sheet 21, both sides of which have been printed, is delivered out of the fixing unit 8, as shown in FIG. 3, the gate 18 is swung after the singly printed sheet 20 is moved back into the printing machine by the reversing roller 16, so that the doubly printed sheet 21 is delivered to the stacker 19. For this purpose it is necessary to convey sheets spaced at relatively long time intervals to thereby prevent sheets from crossing each other on the reverse plate 15. However, since the drum 1 is rotated at a constant speed, if the sheets are conveyed at such long time intervals, then the printing speed of the printing machine is greatly decreased.

FIG. 4 shows another example of the conventional duplex printing machine. In the printing machine, a sheet, one side of which has been printed, is delivered to a switch-back mechanism 23 by a switching gate 22 provided immediately after the fixing unit 8. The sheet is moved backwardly by the switch-back mechanism 23 once more into the printing section so that the other side of the sheet is printed. Thereafter, the switching gate 22 is operated to deliver the doubly printed sheet to the stacker 19. The printing machine of FIG. 4 is disadvantageous in that the sheet conveying path is long, and since the number of switching gates is larger by one than that in the printing machine of FIG. 1, the construction is correspondingly intricate.

In general, in a double sided printing operation, the operator cannot observe the sheet during printing, or he can see only one side of the sheet and if, in the case of printer, the sheets printed are not stacked in the order of page numbers, then the operator must later rearrange the sheets in the order of page numbers. In this connection, both of the two methods described above are disadvantageous in that, in printing only one side of each sheet, the sheets printed are stacked on the stacker 19 in the reverse order of page numbers as shown in FIG. 5, in which reference numeral (1) through (5) designates the first through fifth pages, respectively, and reference character a designates the printed surface.

SUMMARY OF THE INVENTION

Accordingly, an object of this invention is to provide a duplex printing machine in which the abovedescribed difficulties accompanying a conventional perfecting machine have been eliminated.

The foregoing object and other objects of the invention have been achieved by the provision of a duplex printing machine which, according to the invention, comprises sheet delivery means for delivering a sheet which is printed by the printing section of the printing machine, a switch-back mechanism having reverse roller means for moving backwardly the sheet which has been delivered out of the printing section by the sheet delivering means, and a switching gate provided immediately after the switch-back mechanism. The switching gate either selects a first sheet path along which each sheet whose one side has been printed is returned to the printing section so that the other side is printed or selects a second sheet path along which the sheet whose both sides have been printed in conveyed to a stacker after being moved backwardly again by the switch-back mechanism when delivered out of said printing section.

The nature, principle and utility of the invention will become more apparent from the following detailed description when read in conjunction with the accompanying drawings, in which like parts are designated by like reference numerals.

DETAILED DESCRIPTION OF THE PREFERRED EMBODIMENT

Figure 1:
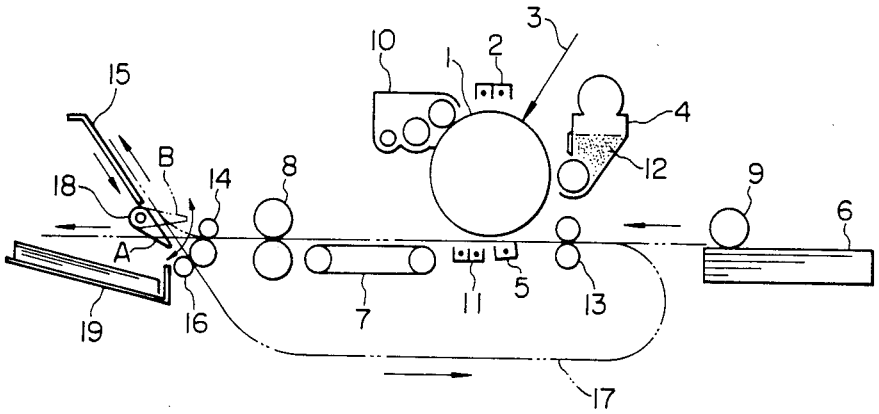
FIG. 1 is a side view showing the arrangement of one example of/a conventional duplex printing machine.
Figure 2:
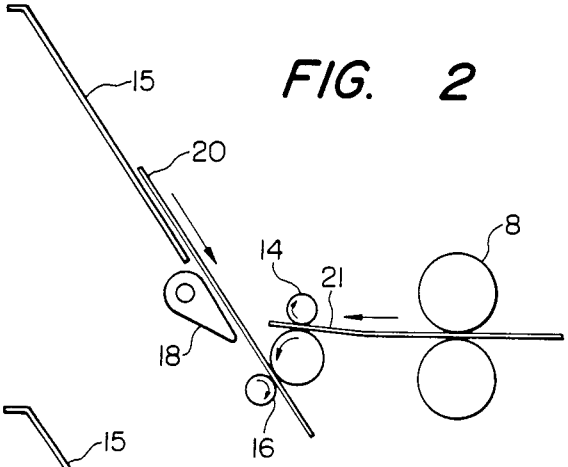
FIG. 2 and 3 are explanatory diagrams for a description of the operation of a switch-back mechanism in the conventional duplex printing machine.
Figure 3:
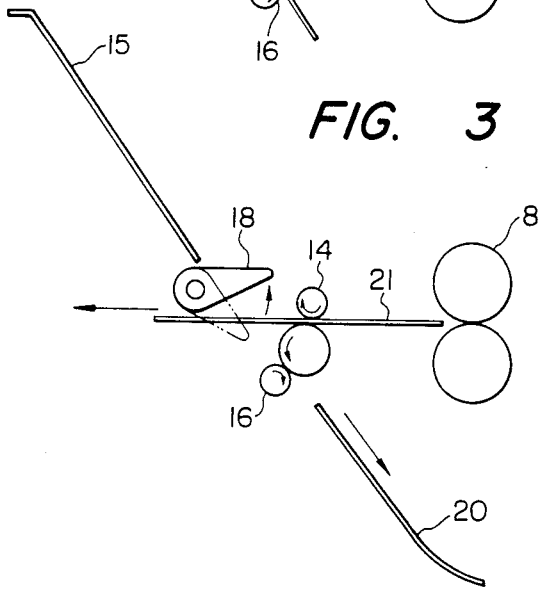
Figure 4:
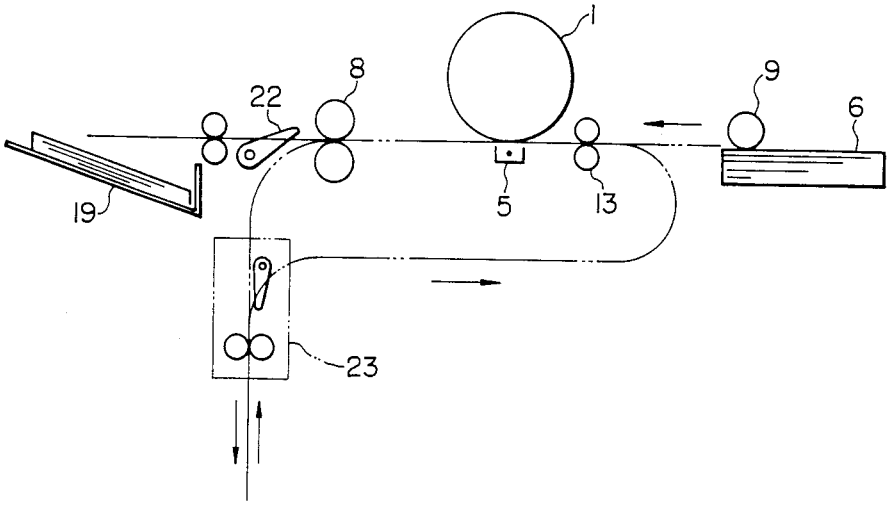
FIG. 4 a side view showing the arrangement of essential components of another example of the conventional duplex printing machine.
Figure 6:
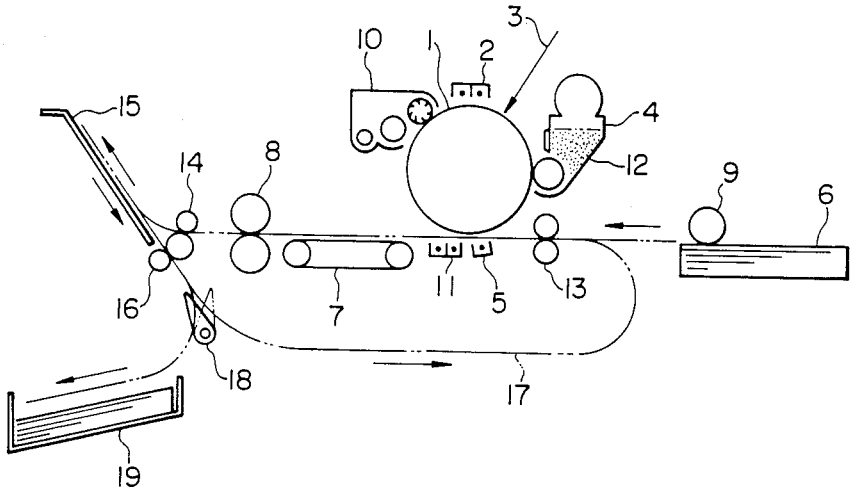
FIG. 6 is a side view showing the arrangement of one example of a duplex printing mechanism according to this invention.
Figure 5:
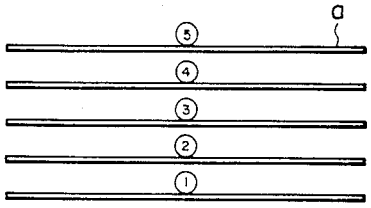
FIG. 5 is an explanatory diagram showing how the sheets, one side of each of which has been printed by the conventional duplex printing machine, are stacked on a stacker.

A electrophotographic printer which is one embodiment of the invention will be described with reference to FIG. 6.

A sheet 20, one side of which has been printed, is delivered to reversing plate 15 by a pair of sheet delivery roller 14, and is then moved backwardly into the machine by a reversing roller 16 which is a switch-back mechanism.

A sheet path switching gate 18 is provided immediately after the reverse roller 16. The switching gate 18 is used to select one of the two sheet paths. One of the sheet paths extends to the printing section of the printing machine, and the other extends to a stacker 19.

The switching gate 18 is operated so that the sheet 20, one side of which has been printed, is moved backwardly along the sheet return path 17 and is fed to a photosensitive drum 1 by a pair of conveying roller 13, where the other side of the sheet is printed in the same manner as had been previously been done for the first side. The sheet is conveyed by a conveying endless belt 7 to a fixing unit 8 where it is subjected to fixing. The sheet thus fixed is delivered again to the reversing plate 15 and is then pulled backwardly by the reversing roller 16. In this operation, the switching is operated again to deliver the sheet to the stacker 19.

The above-described operation is repeatedly carried out to print both sides of sheets.

As is apparent from the above description, the specific feature of the invention resides in that a sheet is moved backwardly twice at one and the same position, and the sheet path switching gate 18 is provided immediately after the switch-back mechanism 15 and 16. Since each sheet is switched backwardly twice at one and the same position as was described above, the operator can observe both sides of each sheet on the reversing plate.

Figure 7:
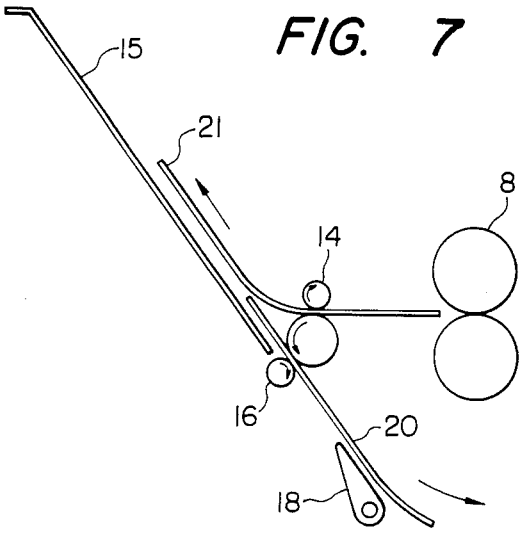
FIG. 7 and 8 are explanatory diagram for a description of the operations of a switch-back mechanism and a switching gate in the duplex printing machine.
Figure 8:
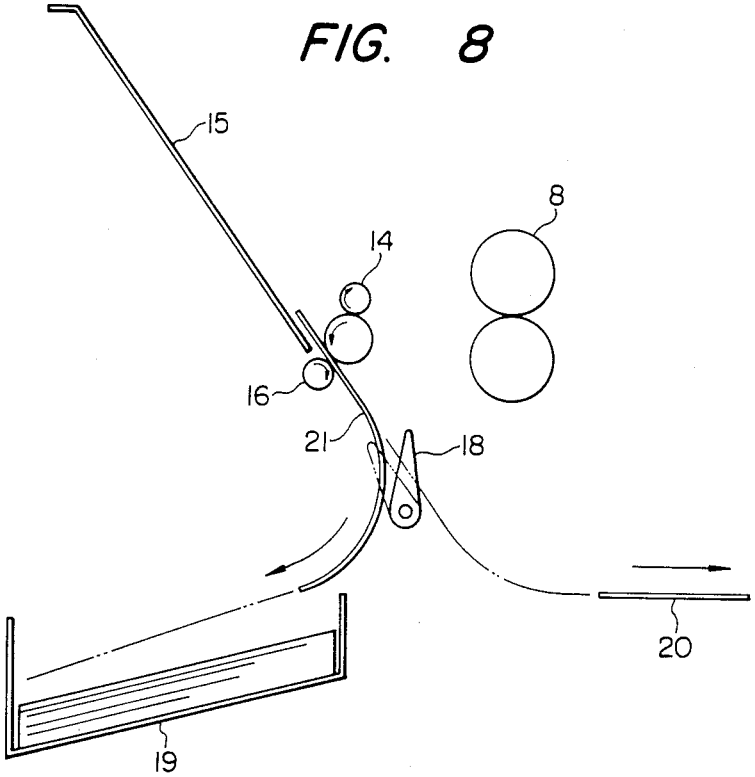

In the duplex printing machine of the invention, unlike the conventional one, switching the sheet paths over to each other is not carried out before the switch-back mechanism 15 and 16. Therefore, the distance between two adjacent sheets 20 and 21 can be decreased as is apparent from FIGS. 7 and 8. Accordingly the printing speed is increased. Furthermore in the printing machine of the invention, immediately after the sheet is delivered to the reversing plate 15, the sheet is moved backwardly by the switch-back mechanism into the printing machine body. Therefore, the total sheet path is minimum.

Figure 9:
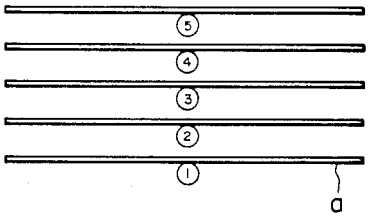
FIG. 9 is an explanatory diagram show in how the sheets, one side of each of which has been printed by the duplex printing machine of the invention, are stacked on a stacker.

In printing one side of each sheet, the switching gate 18 located immediately after the reversing roller 16 is operated so that each sheet is delivered to the stacker 19. In this case, the sheets are stacked on the stacker 19 in the order of page numbers, as shown in FIG. 9.

Figure 10:
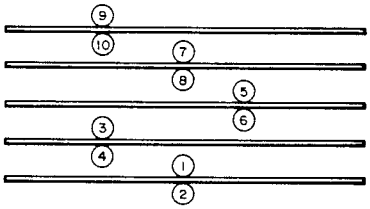
FIG. 10 is an explanatory diagram showing how the sheets, both ides of each of which have been printed by the duplex printing machine of the invention beginning with an odd-numbered page, are stacked on the stacker.
Figure 11:
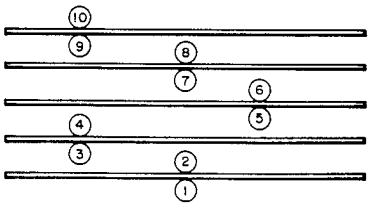
FIG. 11 is an explanatory diagram show in how the sheets, both sides of each of which have been printed by the duplex machine of the invention beginning with an even-numbered page, after stacked on the stacker.

If the double sided printing operation of the printing machine is carried out beginning with an odd-numbered page, then the order of page numbers, as shown in FIG. 10, is reversed when the sheets are stacked on the stacker. This problem can be solved by beginning the printing operation with an even-numbered page. That is, in this case, the sheets are stacked on the stacker in the order of page number as shown in FIG. 11.

Both in the one-sided printing operation and in the two-sided printing operation, the direction of movement of each sheet is switched to the reverse direction on one and the same reversing plate. Therefore the machine operator can observe both sides of each sheet on the reversing plate.

Furthermore, according to the invention, one and the same switching gate is used not only for returning to the printer the sheet whose one side has been printed into the printing machine body for printing the other side but also for delivering the sheets whose both sides have been printed. Accordingly, the switching gate is provided immediately after, the switch-back mechanism. Therefore, in the duplex machine of the invention the construction is simple, and the sheet conveying path is short, with the result that the difficulty of the conventional duplex printing machine that the printing speed is lowered can be eliminated.

Furthermore, in the one-sided printing operation, merely by leading the sheet path to the stacker with the switching gate the sheets moved backwardly at the reversing plate can be delivered out while being turned over as shown in FIG. 9.

What is claimed is:

1. A duplex printing machine which comprises:

a printing section for printing both sides of a sheet;

sheet delivering means for delivering said sheet from said printing section which is printed by the printing section;

a switch-back mechanism having reverse roller means for moving backwardly said sheet which has been delivered out of said printing section by said sheet delivering means;

a stacker section for stacking said printed sheets; and a switching gate disposed after said switch-back mechanism and said reverse roller means in a path extending from said switch-back mechanism, said switching gate selecting a first sheet path along which each sheet whose only one side has been printed is returned to said printing section so that the other side thereof is printed, said sheet having been reversed by said switch-back mechanism, and a second sheet path along which said sheet whose both sides have been printed is delivered to said stacker section after being moved backwardly again by said switch-back mechanism.

2. A duplex printing machine which comprises:

a printing section for printing a side of a sheet;

a switch-back mechanism for moving backwardly each sheet at a predetermined position which has been delivered out of said printing section of said printing machine;

a sheet collecting section for collecting said printed sheets;

a switching gate provided in a path after said switch-back mechanism for selecting a first sheet path extending to said printing section or a second sheet path extending to said sheet collecting section; and means for controlling said switching gate in such a manner that, in the case where both sides of each sheet are to be printed, said switching gate selects said first path to return each sheet whose first side has been printed to said printing section after said switch-back mechanism has reversed the direction of said sheet and then selects said second path to convey said sheet whose second side has also been printed to said sheet collecting section after said sheet is moved backwardly at said predetermined position by said switch-back mechanism.

3. A method of printing both sides of a sheet, comprising the steps of:

conveying a sheet with a first side thereof adjacent a printing mechanism;

printing said first side with said printing mechanism;

conveying said sheet with said printed first side to a reversing mechanism;

reversing a direction of conveyance of said sheet with said printed first side with said reversing mechanism so as to run along a first reversing direction;

conveying said reversed sheet with a second side thereof adjacent said printing mechanism;

printing said second side of said reversed sheet with said printing mechanism, to thereby produce a doubly printed sheet;

conveying said doubly printed sheet to said reversing mechanism;

reversing a direction of conveyance of said doubly printed sheet with said reversing mechanism so as to run along said second reversing direction; and stacking said doubly printed sheet in a pile of similar doubly printed sheets.

* * * * *